US009724745B2

(12) United States Patent
Maeda et al.

(10) Patent No.: US 9,724,745 B2
(45) Date of Patent: Aug. 8, 2017

(54) PRESS FORMING METHOD

(75) Inventors: Kazuhisa Maeda, Toyota (JP); Kiyoshi Nonomura, Nisshin (JP); Yoshiyuki Fukuyama, Toyota (JP); Takayuki Yamano, Kakogawa (JP); Jiro Iwaya, Kakogawa (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 425 days.

(21) Appl. No.: 13/392,418

(22) PCT Filed: Dec. 24, 2009

(86) PCT No.: PCT/JP2009/007179

§ 371 (c)(1),
(2), (4) Date: Apr. 27, 2012

(87) PCT Pub. No.: WO2011/024246

PCT Pub. Date: Mar. 3, 2011

(65) Prior Publication Data

US 2012/0204619 A1 Aug. 16, 2012

(30) Foreign Application Priority Data

Aug. 26, 2009 (JP) ..... 2009-195839

(51) Int. Cl.
*B21D 22/22* (2006.01)
*B21D 22/26* (2006.01)
*B21D 22/24* (2006.01)

(52) U.S. Cl.
CPC ..... *B21D 22/22* (2013.01); *B21D 22/26* (2013.01); *B21D 22/24* (2013.01)

(58) Field of Classification Search
CPC ..... B21D 5/02; B21D 22/30; B21D 22/22; B21D 22/26; B21D 22/24; B21D 22/10;
(Continued)

(56) References Cited

U.S. PATENT DOCUMENTS 689,280 A * 12/1901 Brown ..... B21D 17/04
72/179
2,002,097 A * 5/1935 Peterson ..... 72/297
(Continued)

FOREIGN PATENT DOCUMENTS

CA 2339648 A1 3/2000
CN 1974048 A 6/2007
(Continued)

OTHER PUBLICATIONS

International Search Report mailed Feb. 2, 2010 of PCT/JP2009/007179.

*Primary Examiner* — David Bryant
*Assistant Examiner* — Lawrence Averick
(74) *Attorney, Agent, or Firm* — Andrews Kurth Kenyon LLP

(57) ABSTRACT

A press forming process forms a blank, which is the material to be pressed, into a product having a predetermined shape including a continuous hat-shaped section in the longitudinal direction and a curved portion protruding toward the top surface side in the longitudinal direction. In the press forming process, an intermediate product which has an excess thickness portion formed at a part of the curved portion of the product and protruding higher than the top surface of the product is formed while constraining the portion of the intermediate product other than the excess thickness portion until the excess thickness portion projects in a direction opposite to the protrusion direction thereof, whereby the intermediate product is formed into a predetermined shape.

1 Claim, 10 Drawing Sheets

(58) Field of Classification Search
CPC .... B21D 39/021; B21D 24/12; B21D 37/104; B21D 22/28; B21D 7/0225; B21D 7/06; B21D 9/03
USPC ..... 72/702, 347, 348, 350, 379.2, 57, 312, 72/313, 349, 368, 380, 381, 466, 475, 72/470, 474, 386, 394, 399
See application file for complete search history.

(56) References Cited

U.S. PATENT DOCUMENTS

| | | | | |
|---|---|---|---|---|
| 3,499,308 | A * | 3/1970 | Ford | 72/380 |
| 5,211,047 | A * | 5/1993 | Kaneyuki | 72/313 |
| 6,089,072 | A | 7/2000 | Fields | |
| 7,213,437 | B2 * | 5/2007 | Osumi et al. | 72/379.2 |
| 2001/0013239 | A1 * | 8/2001 | Yamano et al. | 72/350 |
| 2001/0037668 | A1 | 11/2001 | Fields | |
| 2001/0052255 | A1 * | 12/2001 | Arai | 72/379.2 |
| 2004/0173002 | A1 * | 9/2004 | Ingvarsson | 72/379.2 |
| 2005/0262917 | A1 * | 12/2005 | Osumi et al. | 72/379.2 |
| 2007/0125149 | A1 | 6/2007 | Yoshitome et al. | |
| 2008/0098789 | A1 | 5/2008 | Hori et al. | |
| 2009/0205394 | A1 * | 8/2009 | Luckey et al. | 72/379.2 |
| 2009/0272171 | A1 * | 11/2009 | Golovashchenko | 72/348 |

FOREIGN PATENT DOCUMENTS

| | | | | |
|---|---|---|---|---|
| JP | 2004181502 | A * | 7/2004 | |
| JP | 2006-116554 | A | 5/2006 | |
| JP | 3864899 | B2 * | 1/2007 | B21D 5/01 |
| JP | 2007-222906 | A | 9/2007 | |
| JP | 2008-018442 | A | 1/2008 | |
| JP | 2008-200709 | A | 9/2008 | |

* cited by examiner (a)

Prior Art (b)

PRESS FORMING METHOD

This is a 371 national phase application of PCT/JP2009/007179 filed 24 Dec. 2009, which claims priority to Japanese Patent Application No. 2009-195839 filed 26 Aug. 2009, the contents of which are incorporated herein by reference.

TECHNICAL FIELD

The present invention relates to a press forming method, and specifically to a technique of reducing springback of the formed part.

BACKGROUND ART

When press forming a sheet blank into a metal part having a shape bent along the longitudinal direction and a box or hat section, after removing the metal part from a forming die, the bending stress from the die is released and the formed metal part returns toward the releasing direction of the bending stress (springback occurs). The springback often occurs in the bent portion of the metal part, and the dimensions of the bent portion of the formed metal part cannot be controlled with high accuracy.

The conventional forming die considers the predicted springback, and the shape of the die is modified so that the desired dimensions of the formed part are obtained. In recent years, the metal part is required to be light and of high strength, so that the metal part is often made of high-strength steel. The high-strength steel leads a large amount of springback after press forming, and it is difficult to keep accurate dimensions, therefore the forming die may be adjusted time and again. An increase in number of adjusting may lead an increase of production time and costs.

A technique of solving the above-mentioned problems is disclosed in JP 2007-222906 A or JP 3864899 B1.

JP 2007-222906 A discloses the press forming method for forming a metal part having a curved shape in the longitudinal direction, which includes a first forming step of forming an intermediate product having protrusions at the top surface and a second forming step of pressing the protrusions to make the top surface flat and forming the final product. According to the technique, the tensile stress in the longitudinal direction may be reduced and the amount of springback may be decreased.

The metal part formed by the forming method according to JP 2007-222906 A has the flat top surface. As shown in FIG. 14(*a*), the protrusion 120, which is formed on the top surface 110 of the metal part 100 in the first forming step, is pressed in the second forming step, and the pressing process occurs a stress differential between the front surface and the back surface in the direction perpendicular to the longitudinal direction (width direction) of the metal part 100. Thereby, the springback may occur in the width direction, which also leads the springback in the longitudinal direction of the metal part 100 as shown in FIG. 14(*b*), and thus it is difficult to keep the dimensional accuracy.

JP 3864899 B2 discloses the press forming method including a preliminary forming step of forming the top surface and the walls by using the small punch and a finishing step using the finishing punch. The small punch bends the walls to the direction opposite to those of the final metal part, thereby reducing the springback of the walls after finishing.

During the finishing step, the finishing tool is used, which includes a punch for forming the predetermined section in which the top surface has the recess, and a dice having the projection facing the recess of the punch. The top surface is formed with the projection projecting inwardly just before the lower dead end of the finishing stroke.

As shown in FIG. 15, in the press forming method of JP 3864899 B2, during the finishing step using the finishing punch 160 after the preliminary forming using the small punch 150, the wall 170 is not entirely held by the die set 180. Therefore, there may occur wrinkles or cracks in the formed metal part. Particularly, as shown in FIG. 15, at the boundary portion 175 between the wall 170 and the top surface 190, the wrinkles or cracks may easily occur.

CITATION LIST

Patent Literature

PTL 1: JP 2007-222906 A
PTL 2: JP 3864899 B2

SUMMARY OF INVENTION

Technical Problem

The present invention aims to provide a press forming method with high dimensional accuracy and being enabled to reduce costs of preparation for mass production through a reduction of number of modifying the forming die or the like.

Technical Solution

A press forming method according to the present invention is a method of forming a material to be formed into a product having a predetermined shape including a continuous hat section in a longitudinal direction and a curved portion along the longitudinal direction protruding toward a top side. In the press forming method, an intermediate product including an excess portion at the curved portion protruding higher than the top of the product is formed into the predetermined shape. While holding the intermediate product except the excess portion, the excess portion is formed to project toward a direction opposite to the protrusion direction thereof.

In the preferable embodiment, the excess portion of the intermediate product is formed in the range corresponding to the top of the product.

More preferably, in the range where the excess portion is formed, a width of the excess portion from the start point of the excess portion to the end point along any section perpendicular to the longitudinal direction is substantially equal to a width of the product from the point corresponding to the start point of the excess portion to the point corresponding to the end point of the excess portion along the same section.

In the alternative embodiment, in the range where the excess portion is formed, a profile of the top of the excess portion of the intermediate product along the longitudinal section and a profile of a bottom of a recess formed in the product projecting opposite to the excess portion along the longitudinal direction are substantially similar.

Advantageous Effects of Invention

According to the press forming method of the present invention, the dimensional accuracy of the formed product is improved and the reduction of costs for preparation of the mass production is achieved through decreasing the number of modifying the forming die.

DESCRIPTION OF EMBODIMENTS

Figure 1:
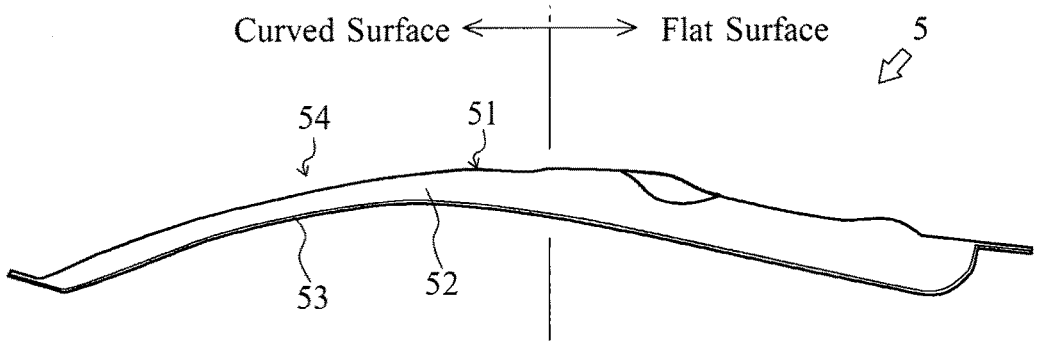
FIG. 1 is a side view of a product obtained by a press forming method according to the present invention.

Referring to attached Drawings, a press forming method according to the present invention is explained. In the press forming method, press forming die sets 1 and 2 are used for forming a product 5, in which multistep press forming is operated.

First die set 1 forms a blank 3 as a material to be formed into an intermediate product 4 which has a predetermined shape. Second die set 2 forms the intermediate product 4 into the product 5 which has a desired shape.

In this embodiment, the width directions of the intermediate product 4 and the product 5 are defined as directions perpendicular to the longitudinal directions of the intermediate product 4 and the product 5, respectively.

The blank 3 is a steel plate made of high-strength steel which has high tensile strength (e.g. about 980 MPa).

The product 5 is a metal part having a hat shape. The product has a continuous hat section in the longitudinal direction viewed from the cross-section, and has a curved shape protruding toward the top side in the longitudinal direction. The product 5 is the final part obtained by the die sets 1 and 2, in which the intermediate product 4 formed by the first die set 1 is press-formed by the second die set 2. The product 5 is, for example, an automobile part such as a center outer pillar or a reinforcing part.

Figure 2:
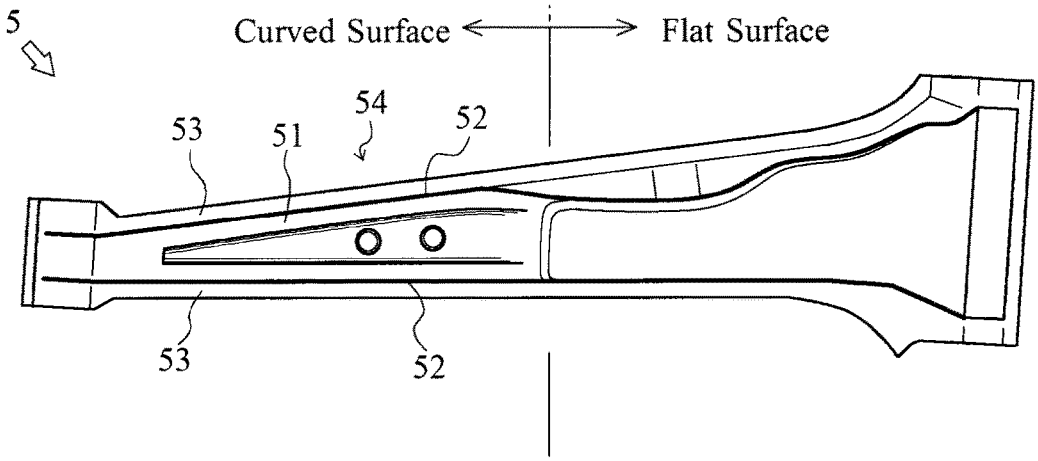
FIG. 2 is a top view of the product.
Figure 7:
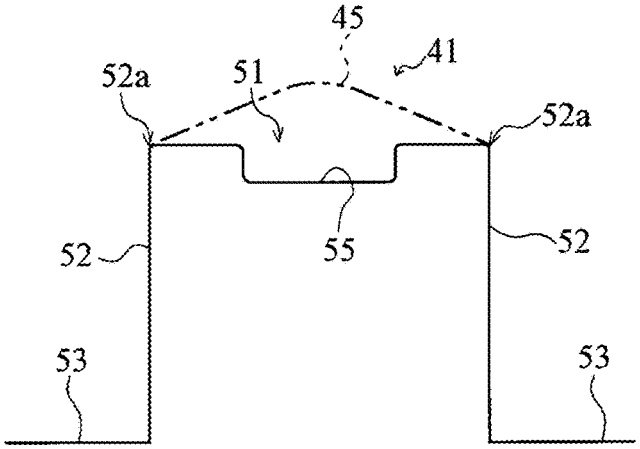
FIG. 7 illustrates an excess portion formed in the intermediate product.
Figure 11:
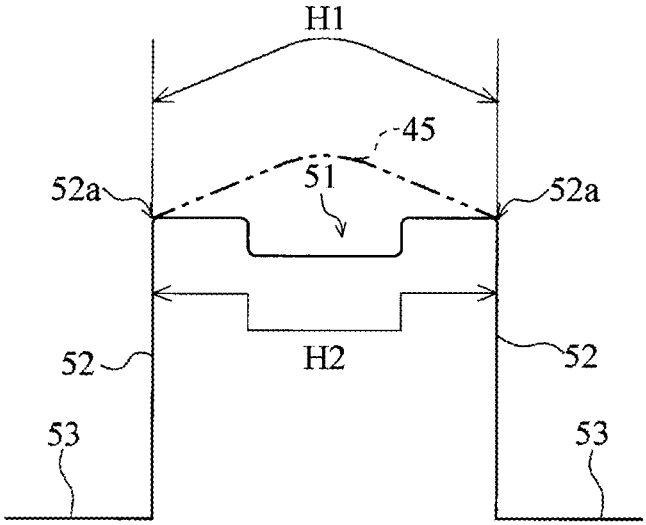
FIG. 11 is a schematic sectional view of the excess portion along the width direction.

As depicted in FIGS. 1 and 2, the product 5 has a top 51 facing the pressing direction of the die sets 1 and 2, two walls 52 formed continuously from the side ends of the top 51, and two flanges 53 formed at the ends (lower ends in FIG. 1) of the walls 52 opposite to the top 51. The top 51 is the top surface of the product 5 having the hat section. As shown in FIGS. 7 and 11, the top 51 is defined between the R corner 52*a* of the edge line of the wall 52 and the opposite R corner 52*a* of the edge line of the other wall 52. Both walls 52 are bent toward the same direction from the top 51, and the flanges 53 are extended from the ends of walls 52 toward the width direction.

As depicted in FIGS. 1 and 2, the top 51 includes a curved surface 54 protruding from the top 51 toward the top side, which is formed in the part of the longitudinal direction (the part from the middle portion to the end in the longitudinal direction, and the area represented as a "curved surface" in drawings). In the top 51, the other part of the curved surface (the area represented as a "flat surface" in drawings) is a flat surface without curvature.

Figure 3:
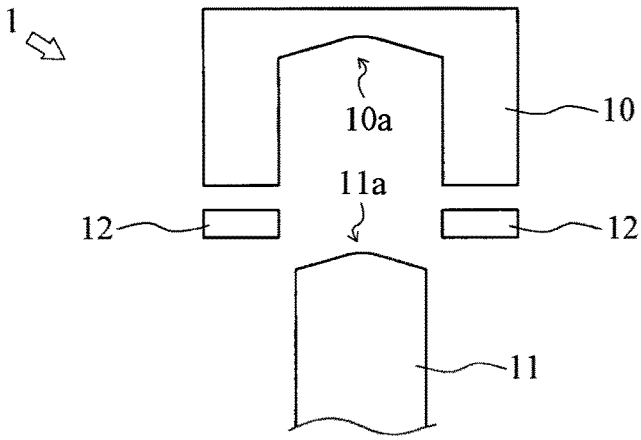
FIG. 3 depicts a first die set.
Figure 4:
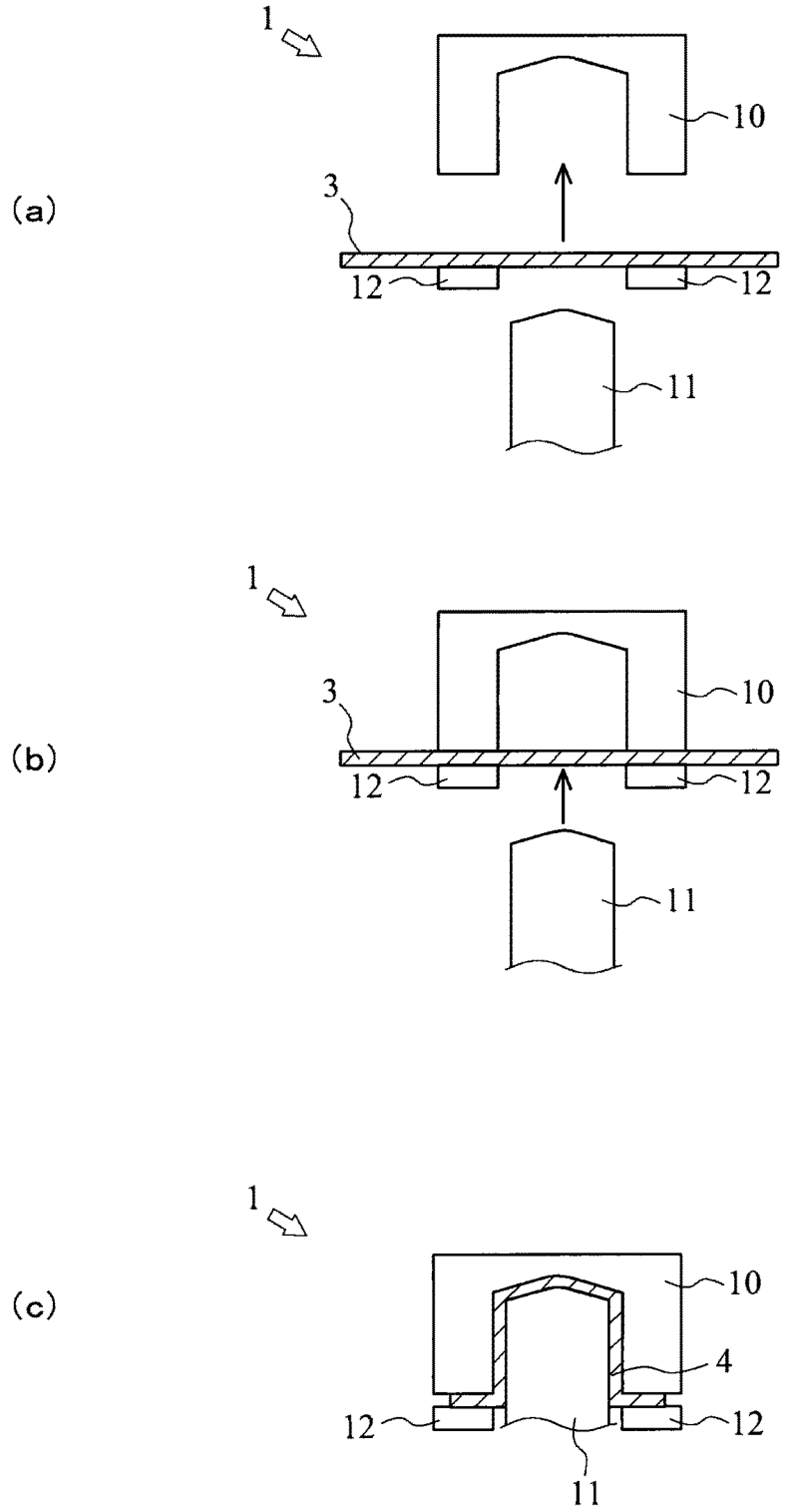
FIG. 4 shows a first press forming step using the first die set.

As depicted in FIG. 3, the first die set 1 includes a die 10, a punch 11 and two blank holders 12. As shown in FIG. 4, the die 10 and the blank holders 12 hold the blank 3, and the punch 11 forms the bank 3 into the predetermined shape.

The die 10 includes a recess 10*a* and the punch 11 includes a projection 11*a* which enters into the recess 10*a* with being spaced at a predetermined gap (the same distance as the thickness of the blank 3) from the recess 10*a* of the die 10. The die 10, the punch 11 and the blank holders 12 are movable relatively thereto and independently thereof.

As shown in FIG. 4, in the first press forming step using the first die set 1, (a) the blank holders 12 on which the blank 3 is mounted move toward the die 10, (b) the blank 3 is clamped by the die 10 and the blank holders 12, and (c) the punch 11 moves toward the blank 3, and the blank 3 is formed into the cavity shape defined between the recess 10*a* of the die 10 and the projection 11*a* of the punch 11, thereby forming the intermediate product 4.

After the first press forming step, the intermediate product 4 is removed from the first die set 1, followed by the second press forming step using the second die set 2.

The first press forming step using the first die set 1 is not limited to this embodiment, and it may be applicable to the step in which the intermediate product 4 is formed. That is, it is applicable that the preforming step for the final product 5, in which the intermediate product 4 having an excess portion 45 at the curved surface 54 that is protruded higher than the top surface 51 of the product 5.

Figure 5:
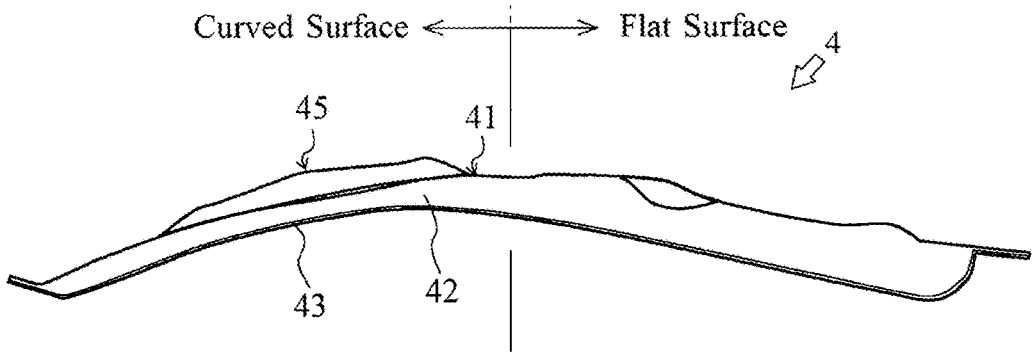
FIG. 5 is a side view of an intermediate product obtained by using the first die set.
Figure 6:
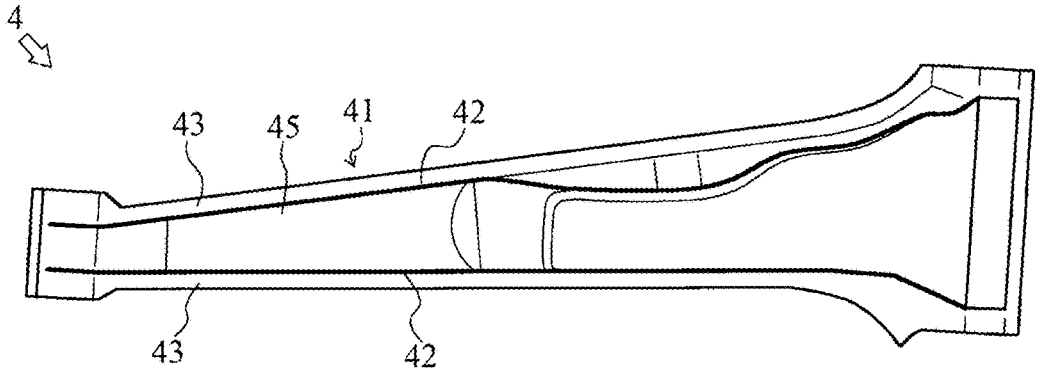
FIG. 6 is a top view of the intermediate product.

As depicted in FIGS. 5 and 6, the intermediate product 4 formed by the first die set 1 has a hat section, and includes a top portion 41, wall portions 42 formed continuously from the side ends of the top portion 41 and flange portions 43 formed at the ends (lower ends in FIG. 5) of the wall portions 42 opposite to the top portion 41.

The top portion 41 has curvature along the longitudinal direction, and the wall portions 42 and the flange portions 43 are formed as the same as the walls 52 and the flanges 53. There is a difference between the top surfaces of the intermediate product 4 and the final product 5 (between the top portion 41 and the top 51).

As shown in FIGS. 1 and 5, the intermediate product 4 is formed with the excess portion 45 in the top portion 41 that is projected higher than the top 51 of the product 5 and is positioned from the end of the curved surface 54 of the top 51 (more specifically, from the start point of the curved surface 54 or around there) to the middle portion of the top. In FIG. 7, the top portion 41 of the intermediate product 4 is raised from the boundary between the top 51 and the walls 52 of the product 5 (that is, the round corners 52*a*) toward the height direction (upper direction in FIG. 7). In the intermediate product 4, the portion where protruded higher than the top 51 of the product 5 is the excess portion 45 that is included in the top portion 41. As described above, the intermediate product 4 is different from the product 5 because the excess portion 45 is formed in the top surface projecting toward the pressing direction of the die sets 1 and 2.

Figure 8:
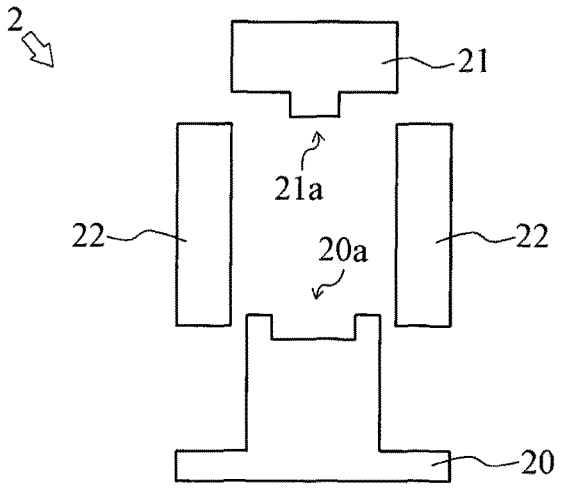
FIG. 8 depicts a second die set.
Figure 9:
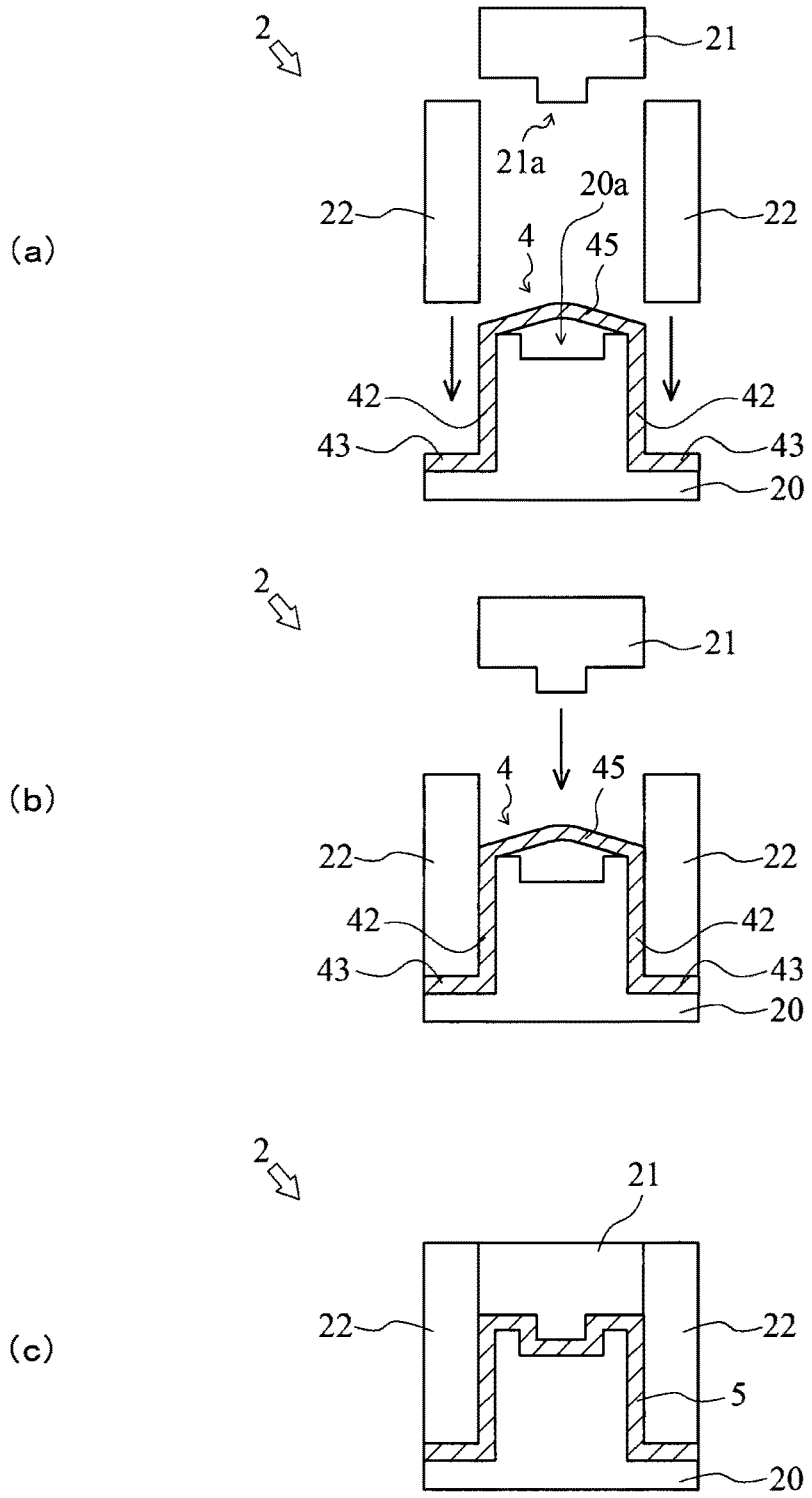
FIG. 9 shows a second press forming step using the second die set.

As depicted in FIG. 8, the second die set 2 includes a punch 20, a bending blade 21 and pads 22. FIG. 9 shows the forming method using the second die set 2, in which the punch 20 and the pads 22 clamp the intermediate product 4 and the bending blade 21 forms the top portion 41 of the intermediate product 4 into the predetermined shape.

The punch 20 includes a recess 20*a* and the bending blade 21 includes a projection 21*a* which enters into the recess 20*a* with being spaced at a predetermined gap (the same distance with the thickness of the intermediate product 4) from the recess 20*a* of the punch 20. The pads 22 engage with the flange portions and the wall portions of the punch 20 spaced at the predetermined distance (the same distance as the thickness of the intermediate product 4), and the pads clamp the intermediate product 4 except the excess portion 45. The punch 20, the bending blade 21 and the pads 22 are movable relatively thereto and independently thereof.

As shown in FIG. 9, in the second press forming step using the second die set 2, (a) the intermediate product 4 is mounted on the punch 20, (b) the pads 22 moves toward the punch 20, and the punch 20 and the pads 22 hold the intermediate product 4 apart from the excess portion 45 (particularly, whole of the wall portions 42), and (c) the bending blade 21 moves toward the intermediate product 4 and the excess portion 45 is crushed and bended such that the projecting direction of the excess portion 45 becomes opposite (namely, the projection becomes recess), thereby obtaining the product 5.

In this embodiment, the bending blade 21 and the pads 22 of the second die set 2 are separated, however, they may be one member in response to the configurations of the intermediate product 4 or the product 5 as long as the second die set 2 holds the intermediate product 4 except the excess portion 45. The above-mentioned "in response to the configurations of the intermediate product 4 or the product 5" means, for example, the case that the product 5 has box section and the intermediate product 4 is configured without the flange portions 43.

Figure 10:
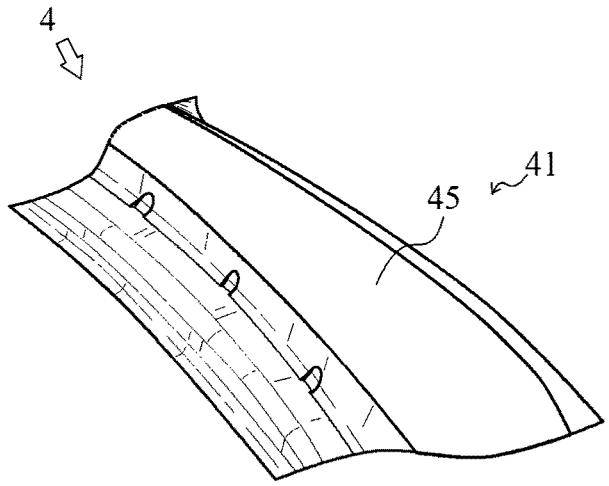
FIG. 10 shows enlarged perspective views, (a) depicts the intermediate product and (b) depicts the product.
Figure 10:
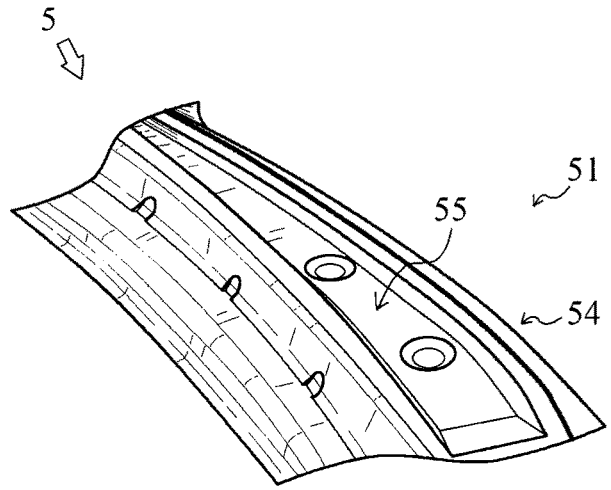

As depicted in FIGS. 9 and 10, the top 51 of the product 5 formed by using the second die set 2 contains a recess 55, that is located at the middle portion in the width direction, projecting the direction (the lower direction in drawings) opposite to the excess portion 45 (projecting in the upper direction in drawings) formed in the intermediate product 4. The recess 55 is formed at which the excess portion 45 is formed in the intermediate product 4 along the longitudinal direction, and the bottom of the recess 55 is flat. That is, the product 5 contains the recess 55 in the part of the curved surface 54 of the top 51 that is configured as the flat surface in the longitudinal direction.

The press forming step includes the first press forming step in which the first die set 1 forms the blank 3 into the intermediate product 4 having the excess portion 45 and the second press forming step in which the second die set 2 forms the intermediate product 4 into the product 5 crushing the excess portion 45 such that the projecting direction thereof becomes opposite.

The intermediate product 4 obtained by the first press forming step with the first die set 1 has the excess portion 45 at the part of the curved portion of the top portion 41 formed with curvature in the longitudinal direction (see FIG. 10(*a*)).

The product 5 obtained by the second press forming step with the second die set 2 has the recess 55 formed with the flat bottom at the curved surface 54 of the top 51 (see FIG. 10(*b*)).

Thus, in the second press forming step, the excess portion 45 formed in the curved portion of the top portion 41 of the intermediate product 4 is compressed to protrude toward the direction opposite to the protrusion direction thereof, so that the compressive stress in the longitudinal direction is added against the tensile stress in the longitudinal direction remained in the excess portion 45 of the intermediate product 4, and the residual compressive stress acted on the top 51 in the longitudinal direction is weakened. Therefore, the springback in the longitudinal direction of the product 5 is reduced.

Moreover, the excess portion 45 is pressed and crushed to protrude toward the opposite direction and thereby weakening the stress differential in the width direction that occurs in the crushing process between the front and back side. Thus, the bending deflection remained in the excess portion 45 is removed, thereby reducing the negative effect of the springback in the width direction of the product 5 (the springback in the longitudinal direction accompanied by the crush of the excess portion) caused by the crush of the excess portion such as the technique of JP 2007-222906 A in which the excess portion is crushed to the flat surface.

In the first press forming step, the excess portion 45 of the intermediate product 4 is formed only in the range corresponding to the top 51 of the product 5, and therefore, during the bending of the excess portion 45 in the second press forming step, the portions other than the excess portion 45 is entirely held by the second die set 2.

Due to the structure, in the press forming step, the material to be press-formed is prevented from flowing out from the top 51, so that the compressive stress is sufficiently added to the top 51 and the residual tensile stress of the top 51 can be reduced. Thus, the springback accompanying the residual tensile stress and the wrinkles caused by the extra material flow can be reduced. Furthermore, the springback is prevented caused by the insufficient reduction of the residual stress on the top 51 due to the flow of the material to be press-formed into the top 51 from the outside of the top 51. The forming defects caused by the above-mentioned effects are prevented.

The spring back of the product 5 not only in the longitudinal direction but also in the width direction can be reduced, so that, to any material of the product 5, the amount of spring back for the final product 5 is easily calculated on the die sets 1 and 2, thereby improving the dimensional accuracy of the product 5. Moreover, the cost reduction is achieved through decreasing of the number of modifying the die. According to the embodiment, in the press forming step for forming the metal part having the box or hat section and the curvature in the longitudinal direction, the high dimensional accuracy after the press forming is provided and the costs for preparation of the mass production is reduced through reducing the number of adjusting the forming die.

The top 51 of the product 5 has the recess 55 formed in the curved surface 54. The recess 55 projects toward inside of the product 5 from the top 51, so that the product 5 can be assembled to the automobile frame without contacting the other parts. Moreover, the recess 55 has the flat bottom, so that the weldability of the product 5 is maintained.

As described above, the excess portion 45 formed in the first press forming step preferably protrudes toward outside from the top surface of the top 51 and the recess 55 formed in the product 5 preferably has the flat bottom.

The excess portion 45 is formed in accordance with the shape of the top 51 of the product 5 and containing at least where the bending stress in the longitudinal direction is maximum. For instance, if the product 5 has the curved surface all over the length, the excess portion 45 may be set containing where the curvature of the curved surface changes (inflection point in the longitudinal section). Thus, the residual tensile stress in the longitudinal direction can be reduced to the utmost extent and the amount of springback can be efficiently reduced.

Figure 12:
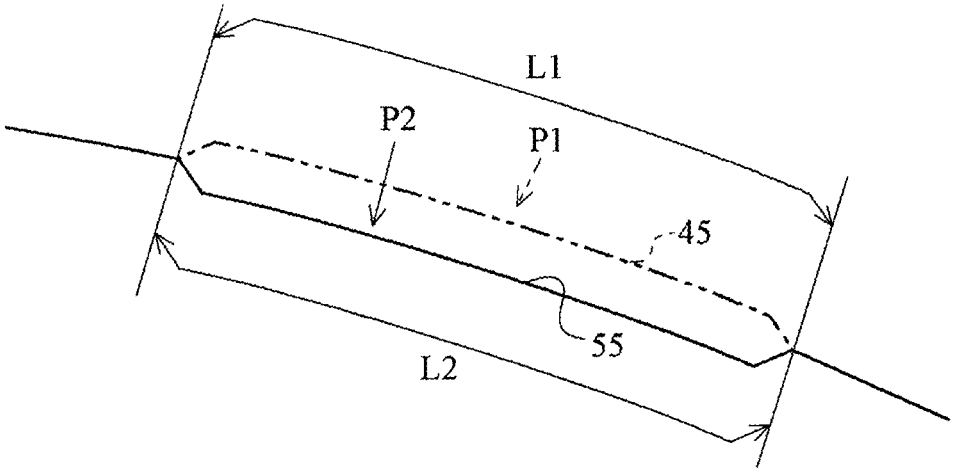
FIG. 12 is a schematic sectional view of the excess portion along the longitudinal direction.

Referring to FIGS. 11 and 12, the advantageous embodiment (amount or shape) of the excess portion 45 in the intermediate product 4 is explained below.

The advantageous amount of the excess portion 45 in the width direction is presented, using the width ratio H2/H1; H1 represents the width of the excess portion 45 of the intermediate product 4 along any width section, and H2 represents the width of the top 51 of the product 5 along the same section.

As shown in FIG. 11, the width H1 is the sectional length of the excess portion 45 from the R corner 52*a* of the one wall 52 to the R corner 52*a* of the other wall 52. The width H2 is the sectional length of the top 51 from the R corner 52*a* of the one wall 52 to the R corner 52*a* of the other wall 52.

Considering the compression and the ratio (flow-in amount of material)/(flow-out amount of material) in the bending of the excess portion 45 during the second press forming step, the ratio H2/H1 is advantageously set around 1.0, and more advantageously set not more than 1.1.

Thus, when the excess portion 45 is bent into the depressed shape, the compression weakening the tensile stress in the longitudinal direction and the suitable tension in the width direction are added to the product 5. As a result, there rarely occurs new stress on the top 51 of the product 5, thereby improving the dimension accuracy of the product 5.

It should be noted that the excess portion 45 is formed in the area containing the end of the curved surface 54 (the point where the curvature changes largely) of the product 5, so that the above-described ratio may not be satisfied at the end of the excess portion 45.

As shown in FIG. 12, in the preferable embodiment, the excess portion 45 is formed such that the profile P1 of the top of the excess portion 45 of the intermediate product 4 viewed from the longitudinal section and the profile P2 of the bottom of the recess 55 of the product 5 viewed from the longitudinal direction are substantially similar, more specifically, similar except the both longitudinal ends of the excess portion 45 and the recess. Due to this embodiment, when pressing the excess portion 45 of the intermediate product 4 in the second press forming step, the new stress on the top 51 of the product 5 is prevented from occurring and thereby keeping the high dimensional accuracy, and the wrinkles in the bottom of the recess 55 of the product 5 are prevented from occurring.

In one embodiment of the configuration in which the profiles P1 and P2 are similar, the bottom shape of the recess 55 that is configured as the curved surface viewed from the longitudinal direction is configured as the polyhedral shape. If the bottom shape of the recess 55 is polyhedral, the surface to be welded is easily controlled, and it is easy to put into the mass production.

Referring to FIG. 12, the advantageous amount of the excess portion 45 in the longitudinal direction is presented, using the length ratio L2/L1; L1 represents the length of the excess portion 45 of the intermediate product 4 along the longitudinal section perpendicular to the longitudinal direction, and L2 represents the length of the bottom of the recess 55 of the product 5 along the longitudinal section. The lengths L1 and L2 are the lengths of profiles P1 and P2, respectively.

Considering the compression and the ratio (flow-in amount of material)/(flow-out amount of material) in the bending of the excess portion 45 during the second press forming step, the length ratio L2/L1 is advantageously set not more than 1.0.

In the alternative embodiment, the product of the width ratio H2/H1 and the length ratio L2/L1 is around 1.0. For example, if the width ratio H2/H1 is 1.1, the length ratio L2/L1 is set 0.9 and therefore the area of the excess portion 45 and the area of the top 51 where the excess portion 45 was formed are substantially same. Thus, when the excess portion 45 is press-formed, the flow-in and flow-out of the material is occurred in the range of excess portion 45, and the wrinkles or cracks of the material to be formed are prevented.

Figure 13:
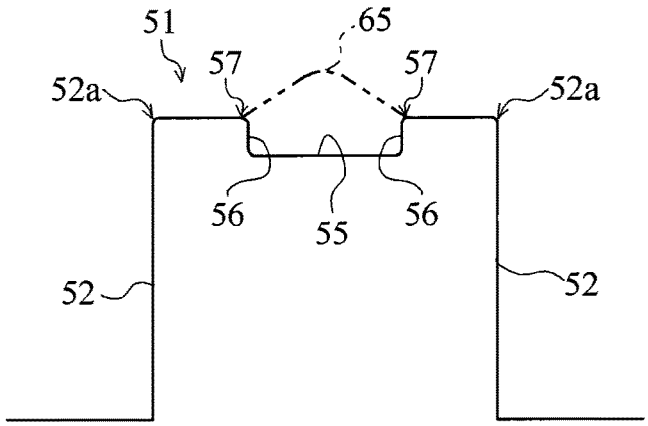
FIG. 13 illustrates an alternative embodiment of the excess portion.
Figure 14:
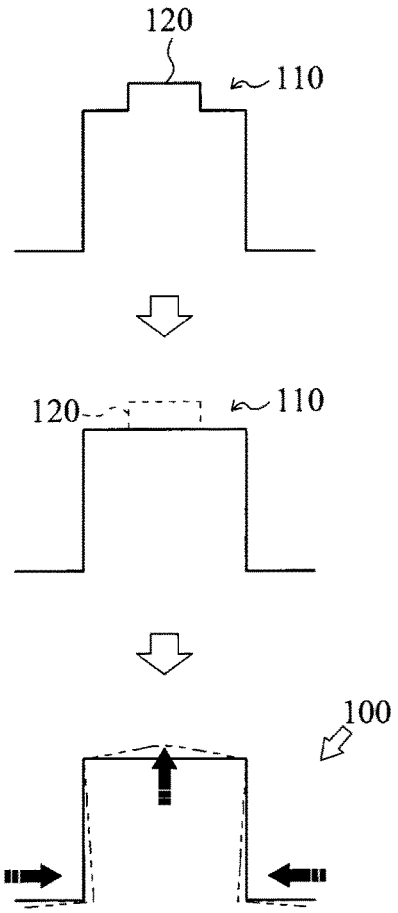
FIG. 14 Prior Art
FIG. 14 shows a prior art of press forming method, (a) is a width section, and (b) is a side view.
Figure 14:
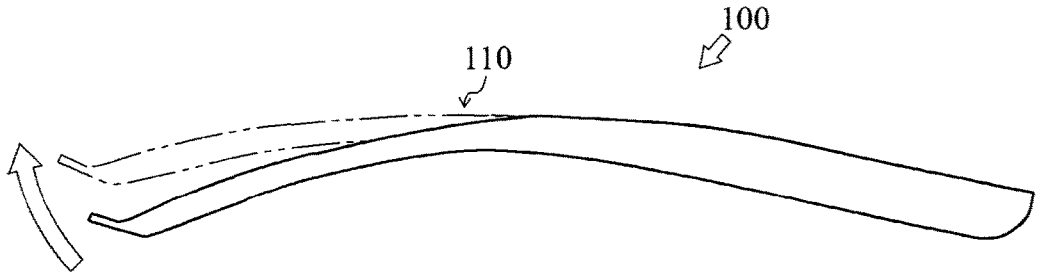
FIG. 14 Prior Art
Figure 15:
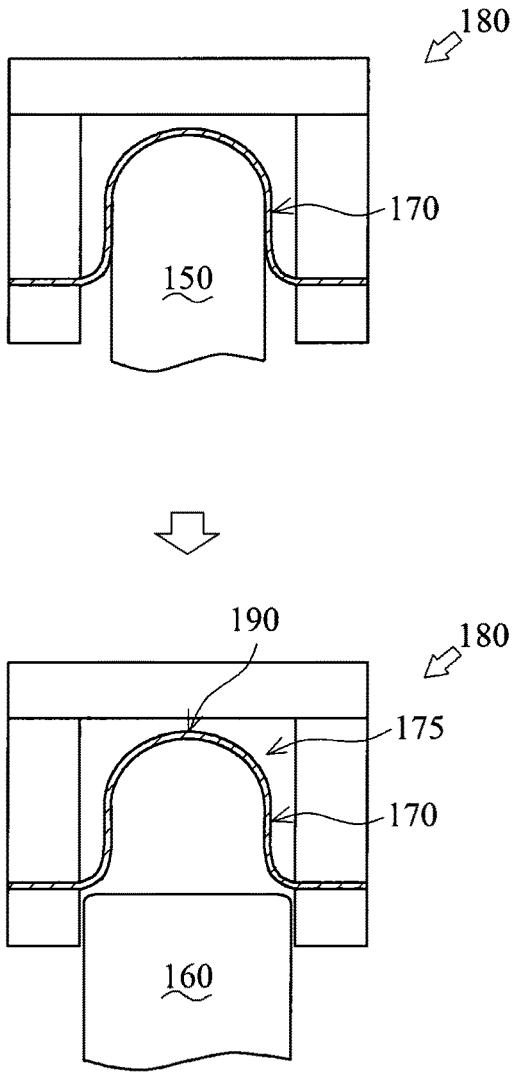
FIG. 15 Prior Art
FIG. 15 shows a prior art of press forming method including a preliminary forming step.

The excess portion formed in the intermediate product 4 by using the first die set 1 may contain the projected portion higher than the top 51 of the product 5. For example, FIG. 13 shows an alternative excess portion 65. The excess portion 65 is formed upward from highest portions 57 of wall portions 56 of the recess 55. That is, in the intermediate product 4, the top portion 41 and the excess portion 65 are connected continuously.

In such case, when the excess portion 65 is compressed to the opposite side by using the second die set 2, the residual tensile stress in the width direction is released, and the amount of springback toward the width direction is reduced. The amount of springback toward the longitudinal direction is also reduced.

INDUSTRIAL APPLICABILITY

The present invention is applicable to a press forming method using a press forming die, especially to the case that the material to be formed leads a large amount of springback or that the product to be formed has the shape where a large amount of springback occurs.

The invention claimed is:

1. A press forming method of forming a material to be formed into a final product having a predetermined shape, the method comprising:

forming an intermediate product including an excess curved portion protruding in a first direction perpendicular to a top surface of the final product, wherein the excess portion of the intermediate product is formed to protrude beyond the top surface of the final product in the first direction in a polyhedral shape, wherein while holding a wall portion of the intermediate product, a recess of the excess portion is formed by partially redirecting the excess portion to project in a second direction opposite to the first direction so that the recess protrudes beyond the top surface of the final product in the second direction, without protruding in the first direction, wherein in a range where the excess portion is formed, a width of the excess portion from a start point of the excess portion to an end point along any section perpendicular to the longitudinal direction is substantially equal to a width of the product from the point corresponding to the start point of the excess portion to the point corresponding to the end point of the excess portion along the same section wherein, in the range where the excess portion is formed, a profile of the top of the excess portion of the intermediate product along the longitudinal section and a profile of a bottom of a recess formed in the product projecting opposite to the excess portion along the longitudinal direction are substantially similar, and wherein the bottom shape of the recess is configured as the polyhedral shape.

* * * * *